US007752687B1

(12) United States Patent
Denosky

(10) Patent No.: US 7,752,687 B1
(45) Date of Patent: Jul. 13, 2010

(54) PATIENT TRANSFER DEVICE

(76) Inventor: James M. Denosky, 972 White Point Blvd., Charleston, SC (US) 29412

( * ) Notice: Subject to any disclaimer, the term of this patent is extended or adjusted under 35 U.S.C. 154(b) by 0 days.

(21) Appl. No.: 12/350,210

(22) Filed: Jan. 7, 2009

Related U.S. Application Data

(63) Continuation of application No. 11/232,164, filed on Sep. 20, 2005, now Pat. No. 7,487,559.

(60) Provisional application No. 60/616,272, filed on Oct. 5, 2004.

(51) Int. Cl.
*A47C 21/06* (2006.01)

(52) U.S. Cl. ..... 5/81.1 HS; 5/87.1

(58) Field of Classification Search ..... 5/87.1, 5/81.1 HS, 81.1 R, 86.1, 626, 627, 89.1; 297/452.4; 280/304.1
See application file for complete search history.

(56) References Cited

U.S. PATENT DOCUMENTS

| | | | | |
|---|---|---|---|---|
| 2,587,068 | A | 2/1952 | Sanders | |
| 2,880,427 | A | 4/1959 | Atwood | |
| 3,945,063 | A * | 3/1976 | Matsuura | 5/611 |
| 3,988,790 | A | 11/1976 | Mracek et al. | |
| 4,272,856 | A | 6/1981 | Wegener et al. | |
| 4,274,168 | A | 6/1981 | Depowski | |
| 4,301,791 | A | 11/1981 | Franco, III | |
| 4,686,719 | A | 8/1987 | Johnson et al. | |
| 4,997,200 | A | 3/1991 | Earls | |
| 5,438,722 | A | 8/1995 | Jayamanne | |
| 5,651,149 | A | 7/1997 | Garman | |
| 5,742,958 | A | 4/1998 | Solazzo | |
| 6,427,270 | B1 | 8/2002 | Blevins et al. | |
| 6,854,137 | B2 | 2/2005 | Johnson | |

* cited by examiner

*Primary Examiner*—Michael Trettel
*Assistant Examiner*—William Kelleher
(74) *Attorney, Agent, or Firm*—Treyz Law Group; G. Victor Treyz; David C. Kellogg

(57) ABSTRACT

Methods and apparatus for transferring patients are provided. A patient transfer device may have a wheeled base and a lateral transfer structure. A patient may lie supine on a patient support structure on top of a transfer sheet. Airbags may be adjusted beneath the transfer sheet to form channels. To transfer the patient from the patient support structure to the wheeled base, the lateral transfer structure is extended into the channels beneath the patient. A stretcher frame is formed from the extended lateral transfer structure. A stretcher that supports the patient is formed by attaching the transfer sheet to the stretcher frame. After the stretcher has been formed, the extended portions of the lateral transfer structure may be retracted to move the stretcher and patient on top of the wheeled base. The patient transfer device may be adjusted to allow the patient to assume a sitting position during transit.

18 Claims, 11 Drawing Sheets

PATIENT TRANSFER DEVICE

This application is a continuation of patent application Ser. No. 11/232,164, filed Sep. 20, 2005, now U.S. Pat. No. 7,487,559 which claims the benefit of provisional patent application No. 60/616,272, filed Oct. 5, 2004, which are hereby incorporated by reference herein in their entireties.

BACKGROUND

The present invention relates to patient transfer devices, and more particularly, to patient transfer devices that help move patients safely and painlessly between stationary environments such as hospital beds or examining tables and mobile environments such as wheel chairs or gurneys.

It is often necessary to move people who are frail and unable to move on their own. For example, it may be necessary to move a patient in a hospital bed to a table in a magnetic resonance imaging (MRI) system. The hospital bed and MRI system are not located in the same room. Hospital beds are generally too large to move about a hospital, so the patient must be moved from the bed to a gurney or wheel chair. The patient is then wheeled to the MRI system and transferred onto the MRI table.

The operations involved in transferring the patient from the hospital bed to the wheelchair or gurney and unloading the patient onto the table can be difficult, particularly when the patient is frail, is recovering from an operation, or suffers from a medical condition that makes movement painful. If the transfer process is too harsh, the patient may experience discomfort or be physically harmed.

Conventional transfer techniques have tended to rely on patient lifts. Lifts generally require a caregiver to roll the patient prior to transfer to position the lift's sling. Patients must then be hoisted from the bed, placed in a wheelchair, and tugged upon to sit them upright in the wheelchair. The entire process is cumbersome, potentially painful for the patient, and poses a risk of injury to both the caretaker and the patient.

It would therefore be desirable to provide improved patient transfer arrangements such as those that avoid the lifting, rolling, bending, and dragging of patients associated with conventional patient transfer methods.

SUMMARY

In accordance with the present invention, methods and apparatus for transferring patients between hospital beds and other patient support structures are provided.

The patient support structures are provided with a transfer sheet. The transfer sheet lies on top of fluid-filled (gas or liquid) bags. The fluid-filled bags may be, for example, inflatable airbags. Tubing may be used to inflate or deflate the airbags and thereby form channels that run perpendicular to the length of the patient support structure and under the patient's body. Padding may be placed over the tubing and under the transfer sheet to shield the patient from the tubing. A mattress pad with flaps may be placed on top of the transfer sheet. When the patient is resting on the patient support structure, the flaps may be extended so that the lateral dimensions of the mattress pad match the patient support structure (e.g., a hospital bed). The flaps can be folded under the mattress pad prior to patient transfer.

A patient transfer device is formed using a wheeled base and a lateral transfer structure. The wheeled base may be a wheelchair base, a gurney base, or any other suitable wheeled base. The lateral transfer structure is attached to the top of the wheeled base.

To transfer the patient from the patient support structure to the wheeled base, the airbags are adjusted to form channels under the patient. The lateral transfer structure is extended under the patient into the channels. With one suitable arrangement, the lateral transfer structure has a number of telescoping slides with attached rotating tubular members that can be used to form a stretcher frame. The stretcher frame may be provided with wheels on the underside to facilitate lateral movement of the patient.

Once the slides have been inserted into the channels, the tubular members are used to form the stretcher frame. The transfer sheet is attached to the stretcher frame to form a stretcher that will support the patient lying in a prone or supine position. The airbags are then adjusted (fully or partially deflated) so that the patient is now supported by the stretcher rather than the airbags. The slides are then retracted, which slides the patient from the patient support structure onto the top of the wheeled base. After using the wheeled base to transport the patient to a desired location, the process may be reversed to transfer the patient onto another patient support structure.

The stretcher formed from the lateral transfer structure may have a removable footrest and a removable headrest. The stretcher may also pivot along its length creating seat and backrest support structures. After the patient has been transferred from the patient support structure to a wheeled base such as a wheelchair base, the headrest and footrest may be removed and the stretcher pivoted to allow the patient to sit.

Further features of the invention, its nature and various advantages will be more apparent from the accompanying drawings and the following detailed description of the preferred embodiments.

DETAILED DESCRIPTION

Figure 1:
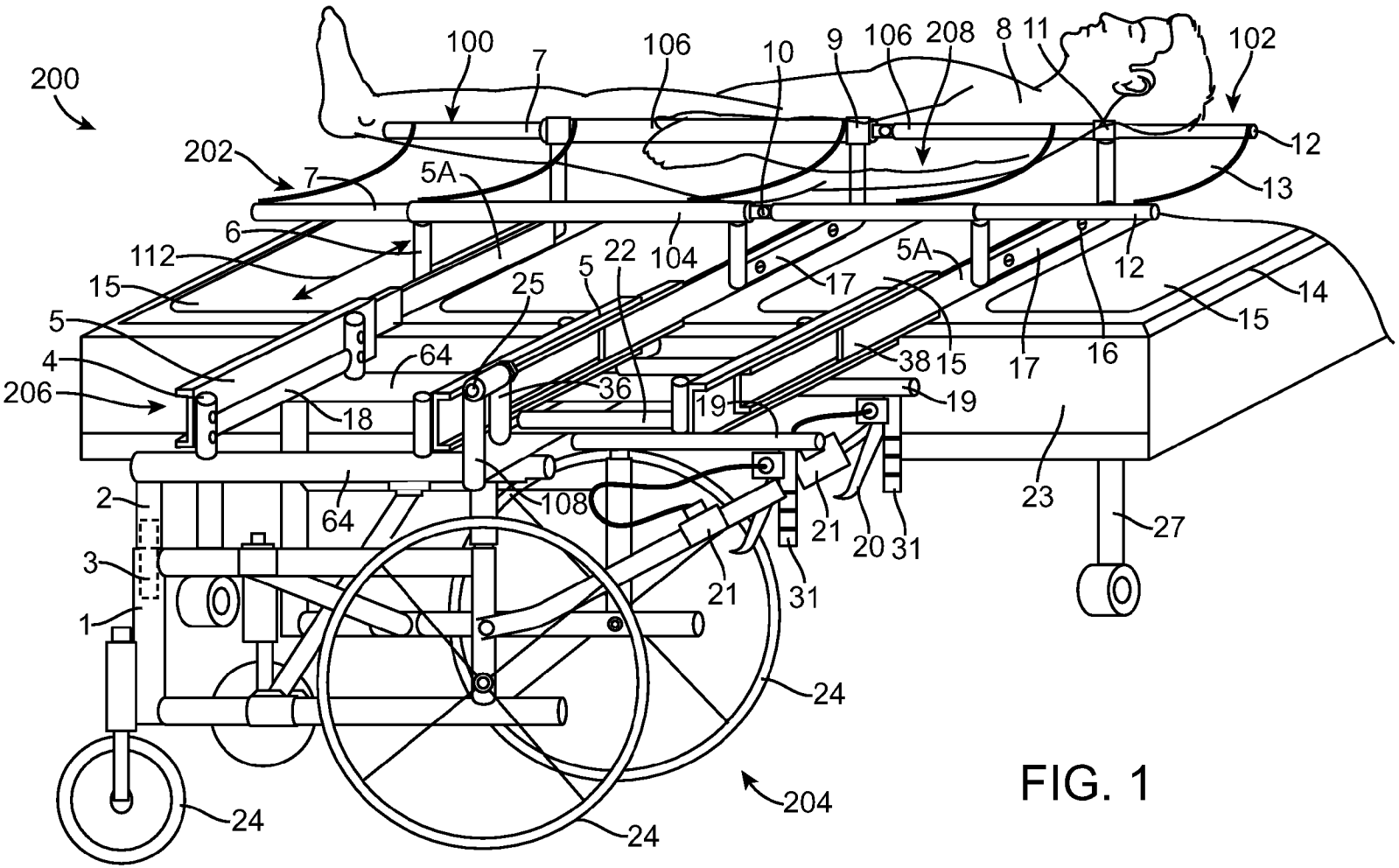
FIG. 1 is a perspective view of an illustrative patient transfer device being used to transfer a patient from a bed in accordance with the present invention.

The present invention relates to moving people within an establishment such as a home, hospital, or other medical facility. Because the people being moved are typically in need of medical assistance, they are referred to herein as patients. The invention provides a patient transfer system. Methods for transferring patients using the system are also provided.

With one suitable arrangement, a mobile patient transfer device is used to transfer patients between stationary structures. The mobile patient transfer device may, as an example, be used to transfer a patient between a hospital bed in one room of a hospital and a table associated with a piece of medical equipment in another room of the hospital.

The patient transfer device may have a wheeled base. The wheeled base may, as an example, be formed from a wheelchair base, a gurney base, or a wheeled cart. An advantage of using a wheeled base formed from a standard component such as a wheelchair is that such components are readily available, are generally not too costly, and are of a size that allows movement through doorways, in halls, in elevators, and other building structures. A lateral transfer structure is attached to the wheeled base. The lateral transfer structure is used to laterally transfer the patient between a patient support structure and the wheeled base. The lateral transfer structure may include sliding cantilevered fork members based on drawer slides, telescoping sliding tubes, linear bearings, or other suitable sliding structures that reduce friction.

In a typical scenario, a patient is supported on a patient support structure such as a hospital bed, table, etc. A transfer pad is provided on top of the patient support structure beneath the patient. The transfer pad can include fluid-filled portions that make the transfer pad adjustable. The fluid-filled portions may include any suitable number of separate fluid-filled bags. By adjusting the transfer pad, the transfer pad can be shaped to accommodate forked portions of the lateral transfer structure as they are inserted in channels under the patient. The transfer pad can also include padding to protect the patient from the fluid supply tubing and can include a mattress pad portion. These parts of the transfer pad can be integrated with the transfer pad or may be separate. The mattress may have flaps that fold up or down or that are removable.

After insertion under the patient, the lateral transfer structure can be adjusted to form a stretcher frame. The stretcher frame may be formed using swinging and telescoping arms or separate attachable members. The transfer pad has a transfer sheet (separate from the fluid-filled bags or integrated with the bags) that is attached to the stretcher frame to form a stretcher that supports the patient. The sheet may be attached with or without straps using buckles, a D-ring connection, snaps, ties, clips, hooks, or other suitable fastening mechanism. The sheet may be formed from a single piece of material or multiple segments.

After the stretcher has been formed under the patient, the inflatable portions of the transfer pad are deflated so the patient rests on the stretcher, and the lateral transfer device is used to manually or automatically transfer the stretcher and patient to the top of the wheeled base. To reduce friction, the lateral transfer structure may have wheels, roller banks, sliding low-friction runners, or other friction reducing mechanisms on the underside. Adjustments may be made to the stretcher once the patient has been transferred to the wheeled base. For example, if the wheeled base is formed from a wheelchair base, the head and foot portions of the stretcher can be adjusted so that the patient can be supported in a sitting position. The headrest and footrest may be detachable or telescopic. A lock may also be engaged that prevents the transfer structure from unintentionally sliding sideways during patient transport.

Structural materials that may be used for the members of the patient transfer device 200 include metal, plastic, composites, carbon fiber, etc. An illustrative patient transfer device 200 is shown in FIG. 1. Also shown in FIG. 1 is a bed 23 and patient 8. In general, the patient 8 may be any person who needs to be moved. The term patient is used herein to emphasize the use of the transfer device 200 in the context of transferring medical patients. Bed 23 is used as an example. In general, any suitable support structure may be involved in supporting a patient.

In the arrangement of FIG. 1, a stretcher 202 has been formed from the patient transfer device and a transfer pad 13. The stretcher 202 supports the patient 8 as the patient and stretcher are laterally transferred from the bed 23 to the wheeled base 204 of the patient transfer device 200. The stretcher 202 may have an extending footrest 100 and an extending headrest 102. Footrest 100 is formed using footrest extending members 7. Headrest 102 is formed as an extension of backrest 208 using headrest extending members 12.

In a typical scenario, wheeled base 204 is a wheelchair base. The footrest 100 and headrest 102 are extended as shown in FIG. 1 when the patient is initially being moved from the bed 23. After the patient has been transferred to the top of the wheelchair base, the backrest 208 is inclined, the footrest 100 and headrest 102 are removed by retracting the extending members. This allows the patient to sit in the transfer device 200 as if it were a conventional wheelchair.

The portion of the patient transfer device 200 that performs lateral translation operations is referred to herein as a lateral transfer structure. In the example of FIG. 1, lateral transfer structure 206 is formed from three parallel slides 5 that extend and retract in the directions indicated by double-ended arrow 112. In general, any suitable type and number of extending members may be used. In the extended position, the slides 5 of the lateral transfer structure are disposed under patient 8, as shown in FIG. 1. In the retracted position, the slides of the lateral transfer structure move the patient on top of the wheeled base.

The wheeled base 204 may be formed from a wheelchair base, a gurney base, or any other wheeled support structure. The use of a wheelchair-type wheeled base is described as an example.

As shown in FIG. 1, the wheeled base 204 has a fixed frame 2 that is connected to vertical members in the wheeled base such as member 1 by sleeves such as sleeve 3. (The position of sleeve 3 is indicated by dotted lines in FIG. 1.) Wheeled base 204 also has wheels 24, hand grips 31, canes 19, brakes 21, and horizontal support members such as horizontal support member 64.

Tubes such as tube 4 attach slides 5 to fixed frame 2. When attached to tubes 4, slides 5 are adjacent to fixed cross members such as cross-member 18. Slides 5 have slide extensions 5A. With one suitable arrangement, the slide extensions nest within the slides 5 when the slide extensions are retracted. Illustrative slide extensions 5A are shown in FIG. 1 in the extended position. The leftmost two slides (shown as slides 5 in FIG. 1) are fixed slides because they are fixed relative to the wheeled base 204. The rightmost slide (shown as slide 38 in FIG. 1) is a pivoting backrest slide that pivots with backrest slide support frame 22, so that the patient can be placed in a sitting position after being transferred to wheeled base 204. Bolt 25 serves as the pivot point that allows the backrest structure to pivot. Bolt 25 attaches arm 36 to member 108. Fasteners such as bolt 16 may be used to attach cross members 17 of the extending portion of the lateral transfer structure 206 to slide extensions 5A. Support posts 6 are used to support the stretcher 202 on the slide extensions such as extensions 5A.

The members that make up the lateral transfer structure can be adjusted to form a stretcher frame while the lateral transfer structure is under the patient. Members 7 and 12 are used to form footrest and headrest portions of the frame. Stretcher lateral support members 104 and 106 are also used in forming the frame. Support member 104 is fixed. Support member 106 is movable. Static tube hinge 10 allows the backrest portion 208 of the stretcher 202 to pivot so that the patient can be placed in a sitting position after the stretcher has been transferred to the wheeled base 204. Tubular T-connectors such as tubular T-connector 11 are used in positioning stretcher support member 106 when forming stretcher 202.

Lateral transfer operations are assisted by the use of a transfer pad. Any suitable transfer pad arrangement may be used. With one suitable arrangement, a transfer pad is used that has a removable transfer sheet 13 and underlying padding portions such as mat 14 and airbags 15.

With this type of arrangement, the stretcher 202 is formed by attaching the transfer sheet 13 to the stretcher frame formed using members 12, 106, 104, and 7. Transfer sheet 13 may be formed from fabric, plastic, or other flexible material and is attached to the frame using anchoring straps. This arrangement is merely illustrative. Any suitable attachment technique and sheet material may be used.

Preferably the padding portion of the transfer pad under transfer sheet 13 has adjustable portions that allow the slide extensions 5A to slide under the patient. Fluid-filled bags 15 such as airbags may be used for this portion of the transfer pad. In general, bags such as bags 15 may be filled using any suitable fluid (e.g., gas, liquid, or liquid-like microspheres). The use of air-filled bags is described as an example. Bags 15 need not be entirely air-filled. For example, padding structures may be formed using both fixed portions (e.g., foam) and adjustable portions (e.g., airbags).

If desired, permanent channels may be provided in padding portion of the transfer pad to accommodate slide extensions 5A. Preferably, however, channels are formed by adjusting the bags 15, and in FIG. 12, bags 78.

With one suitable arrangement, adjustable airbags 15 are provided in the channels. Normally the airbags are inflated to provide a smooth resting surface for the patient. When it is desired to form channels to accommodate the slide extensions 5A, the airbags 78 (FIG. 12) may be deflated. Because the airbags are only deflated when transferring the patient, this type of structure is sometimes referred to as a normally-inflated structure.

Figure 11:
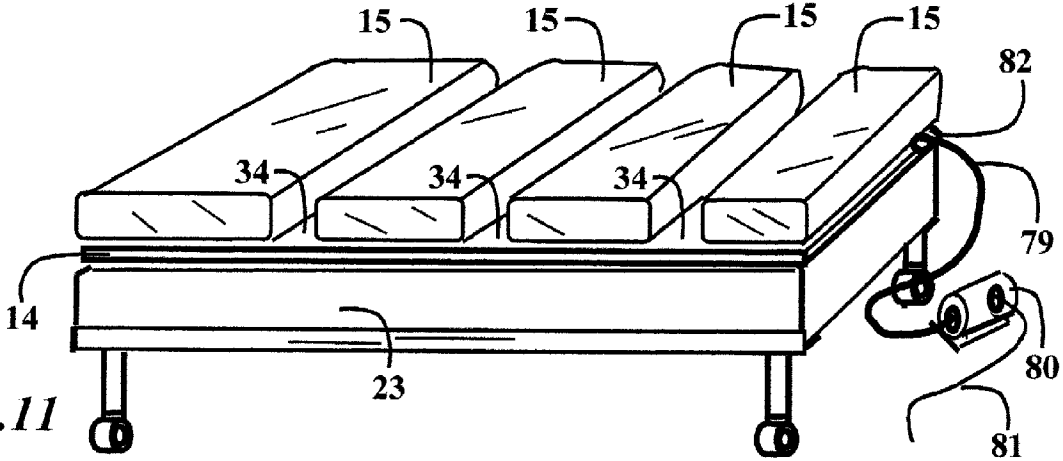
FIG. 11 is a perspective view of a patient support structure with a normally deflated airbag structure in accordance with the present invention.

With another suitable arrangement, airbags 15 form a normally-deflated structure, as shown in FIG. 1 and FIG. 11. Because the airbags are thin, the deflated airbags lie flat and allow the patient to rest comfortably on bed 23. As shown in FIG. 11, when it is desired to form channels to accommodate the slide extensions 5A, the airbags are inflated. As shown in FIG. 1, after the slide extensions 5A have been slid into the channels and stretcher 202 has been formed, the normally-deflated airbags 15 are again deflated so there is no friction when transferring the patient back over the wheeled base 204.

When fluid-actuated structures are used to adjust the padding portions of the transfer pad, the pad will generally contain tubing (e.g., air hoses for inflating/deflating airbags). The padding portion of the transfer pad may have a mat 14 such as a layer of foam or other soft material to help shield the patient from the tubing. The mat 14 may be placed over the tubing and below the airbags 15, as shown in the normally-deflated airbag arrangement of FIGS. 1 and 13.

Figure 2:
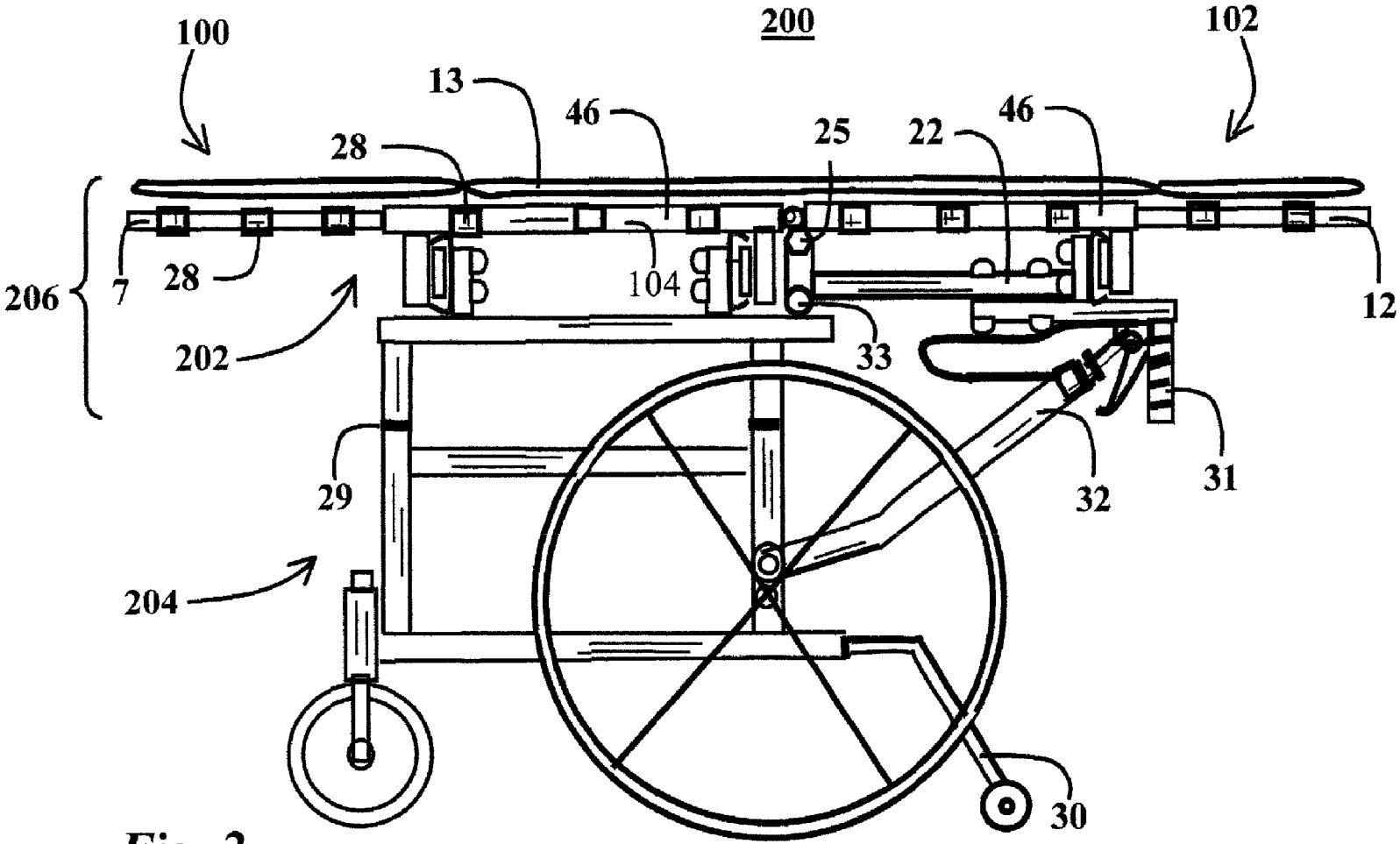
FIG. 2 is a side view of a patient transfer device in a fully reclined position in accordance with the present invention.

A side view of the patient transfer device 200 is shown in FIG. 2. In the configuration shown in FIG. 2, the extending portions of the lateral transfer structure 206 (e.g., slide extensions 5A of FIG. 1) have been retracted. This operation slides the stretcher 202 and patient 8 from the bed 23 to the top of the wheeled base 204. Because the slides 5A support the weight of the stretcher and patient during lateral movement, the patient can be transported from the bed to the wheeled base without undue exertion on the part of the caregiver. The lateral transfer structure 206 is attached to the wheeled base 204 at joints such as joint 29.

In the configuration shown in FIG. 2, the patient lies in a fully reclined position. In this configuration, the patient transfer device 200 operates as a gurney (sometimes referred to as "gurney mode"). In the reclining gurney mode position shown in FIG. 2, the patient transfer device can be pushed and steered by holding the sides of the stretcher 202 or recessed push handles (not shown). Because the footrest 100 and headrest 102 are extended, the patient's feet and head are supported, as with a conventional gurney. Operation in gurney mode may be preferred, for example, when a patient is too weak to sit. When a patient is able to rest in a sitting position, the patient transfer device 200 may be placed in "wheelchair mode." In wheelchair mode, telescoping tubes 32 are used to form part of a patient back support structure.

As shown in FIG. 2, straps 28 may be used to anchor the transfer sheet 13 to the members of the frame of stretcher 202 such as lateral support members 104 (FIGS. 1 and 2) and 106 (FIG. 1). Straps 28 may include VELCRO® fastening structures (hook and loop fasteners) or other suitable fastening structures to facilitate attachment to the frame.

Members such as the members 46 shown in the side view of FIG. 2 are fixed members that are part of the stretcher lateral support member 104. Extending (telescoping) members 7 and 12 are also sometimes referred to as being part of the lateral support member 104.

The wheeled base 204 in the example of FIG. 2 is formed from a wheelchair base and preferably has anti-tipping wheelchair wheels 30. Wheels such as wheels 30 are preferably permanently installed to prevent the wheelchair base from tipping backwards. Wheels 30 help to support headrest 102 and the patient's upper body if the patient's center of gravity were to temporarily shift to the rear part of the stretcher.

Figure 3:
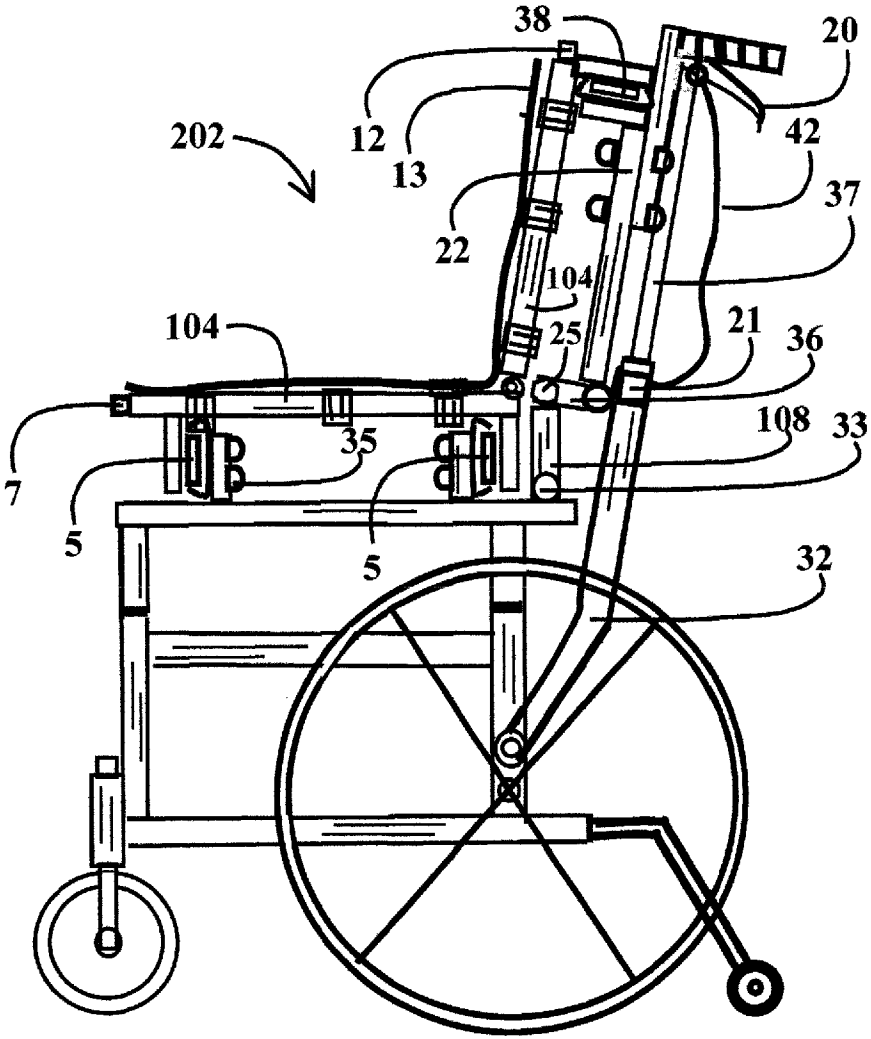
FIG. 3 is side view of the patient transfer device of FIG. 2 after the device has been placed into a position to accommodate a seated patient in accordance with the present invention.

Cross-arm 33 anchors member 108 (FIG. 3) to wheeled base 204. As shown in FIG. 3, member 108 and arm 36 are attached at bolt 25. When it is desired to place the patient transfer device 200 in the wheelchair mode, the arm 36 swings upward into a horizontal position about the pivot point formed by bolt 25, while member 108 remains stationary.

In the configuration of FIG. 3, the telescoping inner portion 37 of telescoping tube 32 is extended. Brake cable 42 extends between the brake 21 and the brake handle 20.

Backrest slide support 22 attaches backrest slide 38 to pivot arm 36. When the stretcher 202 bends as shown in FIG. 3, backrest slide support 22 and backrest slide 38 pivot upward. Slides 5 remain attached to the wheeled base 204 and do not pivot. The transfer sheet 13 is preferably flexible enough to bend in conformity with the bent stretcher shape.

Extending members 7 and 12 are retracted into the lateral support members 104 and 106. In this position, the patient's legs can rest comfortably in a vertical position while the patient is seated in a normal sitting position. The retracted backrest increases patient comfort and increases visibility for the caretaker.

Figures 4, 5:
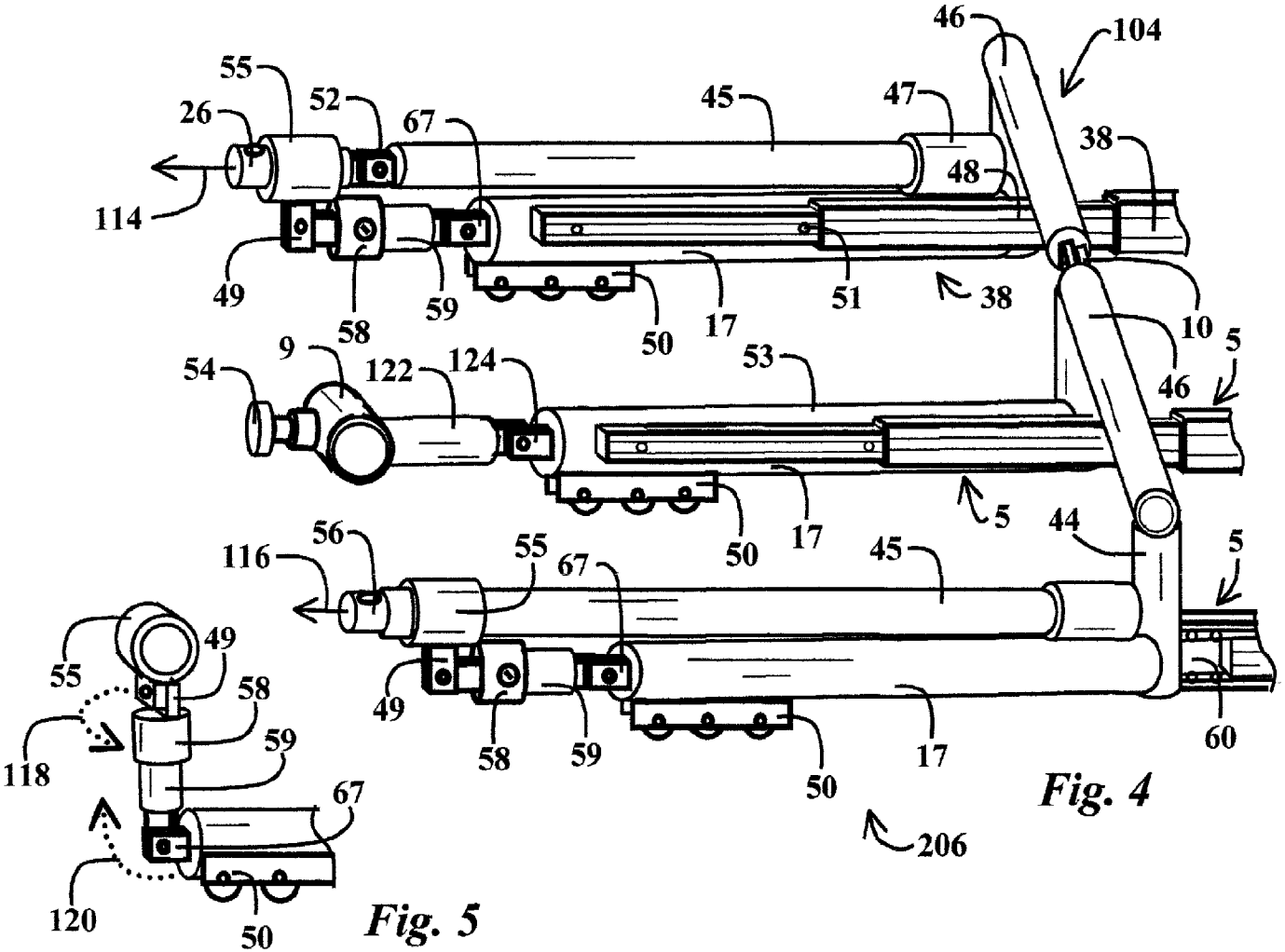
FIG. 4 is a perspective view of a portion of the lateral transfer structure prior to forming a completed stretcher frame in accordance with the present invention.
FIG. 5 is a perspective view showing how hinges and rotating tube connectors can be used in forming a completed stretcher frame from the lateral transfer structure in accordance with the present invention.
Figure 6:
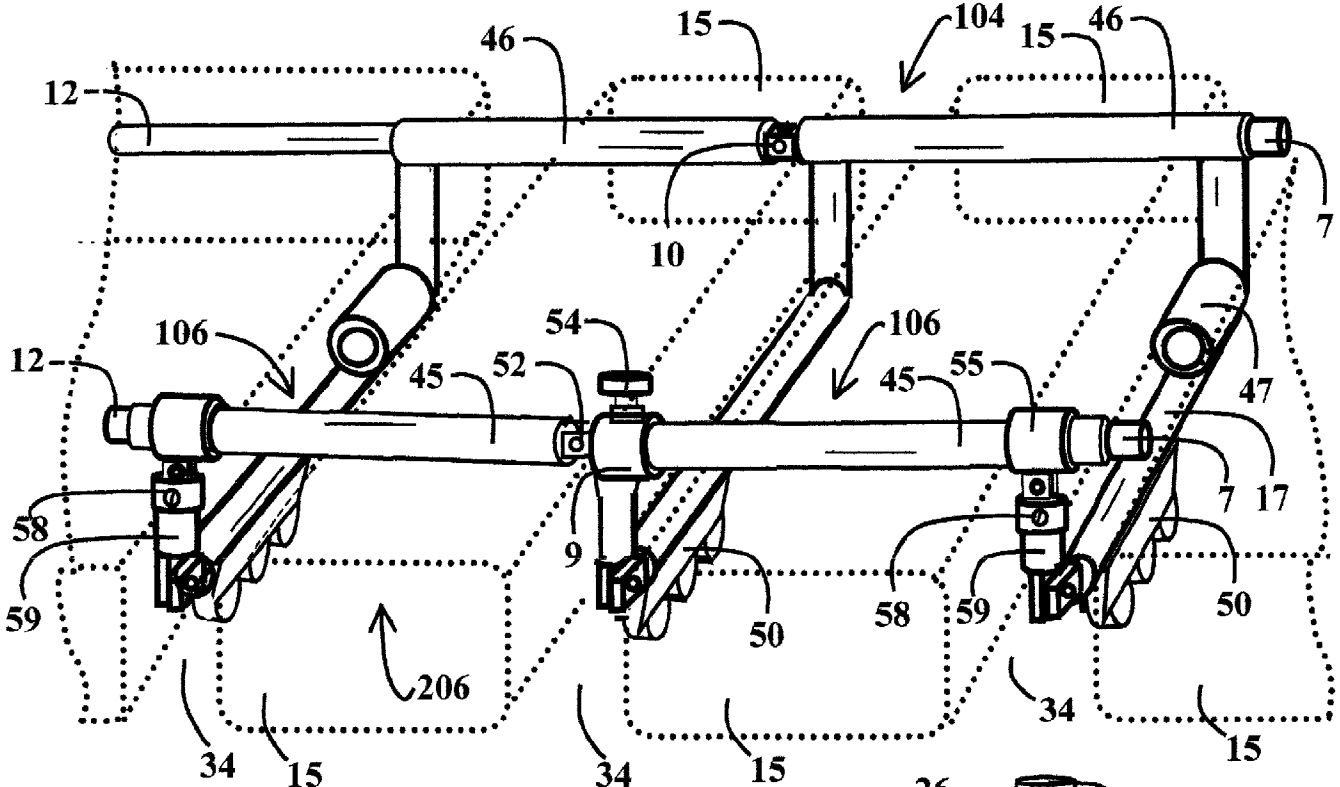
FIG. 6 is a perspective view of a portion of the lateral transfer structure as configured when forming the stretcher frame in accordance with the present invention.

The extending portion of the lateral transfer structure 206 is shown in FIG. 4. Stretcher lateral support member 104, which is made up of members 46, is fixed in place. In the configuration shown in FIG. 4, the movable stretcher lateral support member 106 has not yet been deployed. FIG. 6 shows the lateral transfer structure 206 after lateral support member 106 has been formed.

As shown in FIG. 4, slides 5 and slide 38 run parallel to each other and support a fork-like structure for moving the patient. Wheels 50 (FIG. 6.) are attached to the cross members 17, 53, and 45. During extension and retraction motions, wheels 50 help the lateral transfer structure glide across the bed 23 and support the patient's weight. As a result, the caregiver need exert only minimal effort to transfer the patient.

Support members 53 and 17 are fixed relative to the lateral transfer structure and serve as cross members that are attached to slides 5. Support members 45 pivot to form stretcher lateral support member 106 (FIG. 6). In the configuration of FIG. 4, the stretcher 202 has not yet been formed and members 45 are shown in retracted positions.

To form the stretcher 202, slides 38 and 5 and members 45 and 53 are inserted into the transfer pad channels formed under the patient. The caregiver then pulls out the ends 26 and 56 of members 45 in directions 114 and 116, respectively. This pulls the members 45 out from under the patient onto the side of the bed 23 that is farthest from wheeled base 204. Because the members 45 are no longer confined to the transfer pad channels beneath the patient, they can be rotated to form the stretcher lateral support member 106.

After pulling out the ends 26 and 56 of members 45, the caregiver places members 59 in a vertical orientation by pivoting members 59 90° about tube hinges 67 as shown by dotted-line arrow 120 in FIG. 5, while at the same time maintaining members 45 and 55 in their horizontal orientation by pivoting 90° about hinges 49. As shown in FIG. 4, the caregiver then rotates member 122 90° vertically about tube hinge 124, which places member 9 in a horizontal orientation, aligned with the future position of stretcher lateral support member 106 (FIG. 6).

As shown by the dotted-line arrow 118 in FIG. 5, the caregiver rotates members 45 and 55 90° using rotating tube connectors 58. Members 45 are free to rotate, because they are no longer confined within the channels in the transfer pad. The lateral support member 106 (FIG. 6) is formed by placing the ends 26 and 56 of members 45 through the transfer sheet straps (not shown) and into the open ends of tube member 9 and by securing these ends using locking pin 54.

Figure 7:
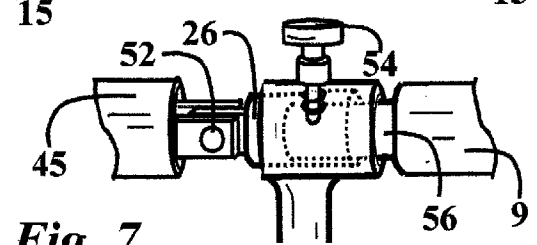
FIG. 7 is a perspective view showing how stretcher frame members can be connected using a locking pin in accordance with the present invention.

Once these operations have been completed, the central portion of stretcher lateral support member 106 has been formed parallel to the stretcher lateral support member 104. FIG. 7 shows how the diameters of tube ends 26 and 56 are configured to allow tube end 56 to nest within tube end 26 before being secured with lock pin 54.

As shown in FIG. 6, the stretcher frame formation process is completed by extending the footrest extending members 7 and headrest extending members 12 from within members 46 and 45.

Figure 12:
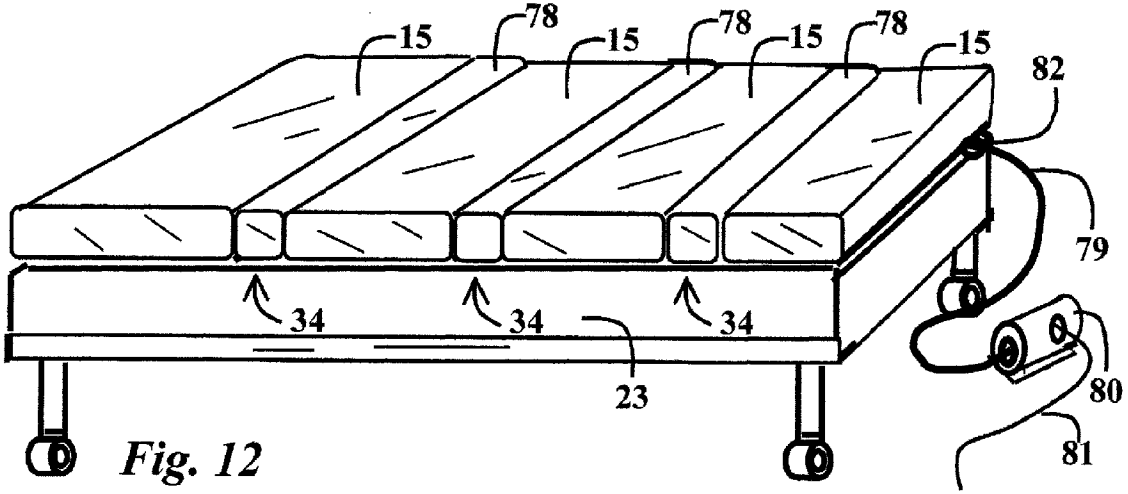
FIG. 12 is a perspective view of a patient support structure with a normally inflated airbag structure in accordance with the present invention.

In the configuration shown in FIG. 6, the airbags 15 define channels 34. In normally deflated arrangements, airbags 15 are inflated to form the channels 34. In normally inflated arrangements as shown in FIG. 12, airbag structures 78 are deflated to form the channels 34. The transfer sheet 13, which is not shown in FIG. 6, preferably lies above the airbags.

Figure 8:
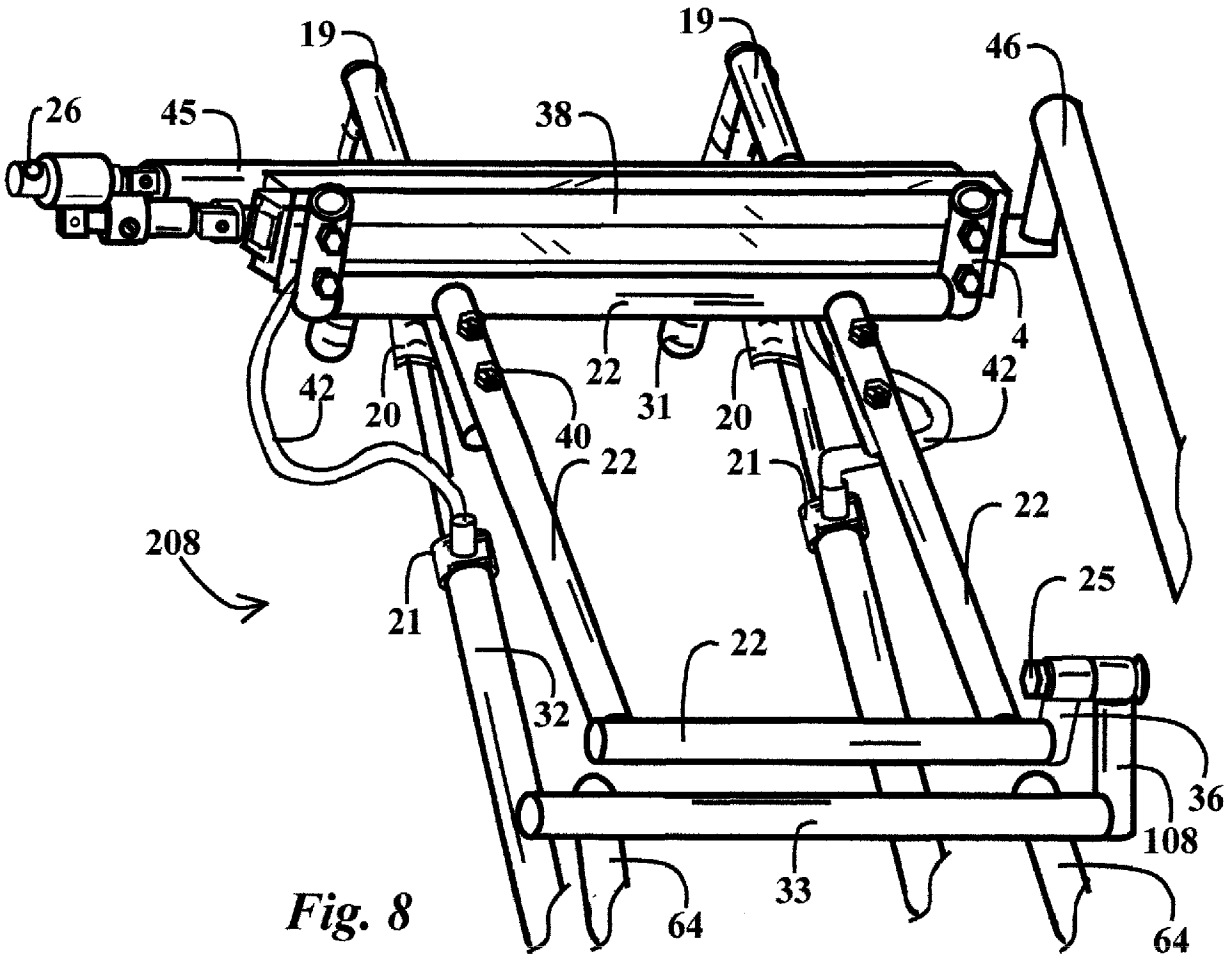
FIG. 8 is a perspective view of the backrest portion of the patient transfer device showing backrest support components that may be used in accordance with the present invention.

FIG. 8 is a view of the backrest portion of the fixed frame 2. FIG. 8 shows how backrest support members 22 and associated members are connected. In the configuration of FIG. 8, the member 45 on slide 38 is in its retracted position, over the top of wheeled base. The backrest 208 is partly inclined (approximately 45 degrees) in the arrangement of FIG. 8, as indicated by the acute angle between members 36 and 108. Bolts 40 join the frame members of backrest 208 to wheeled base components such as wheelchair cane 19 and handle grip 31.

Figure 9:
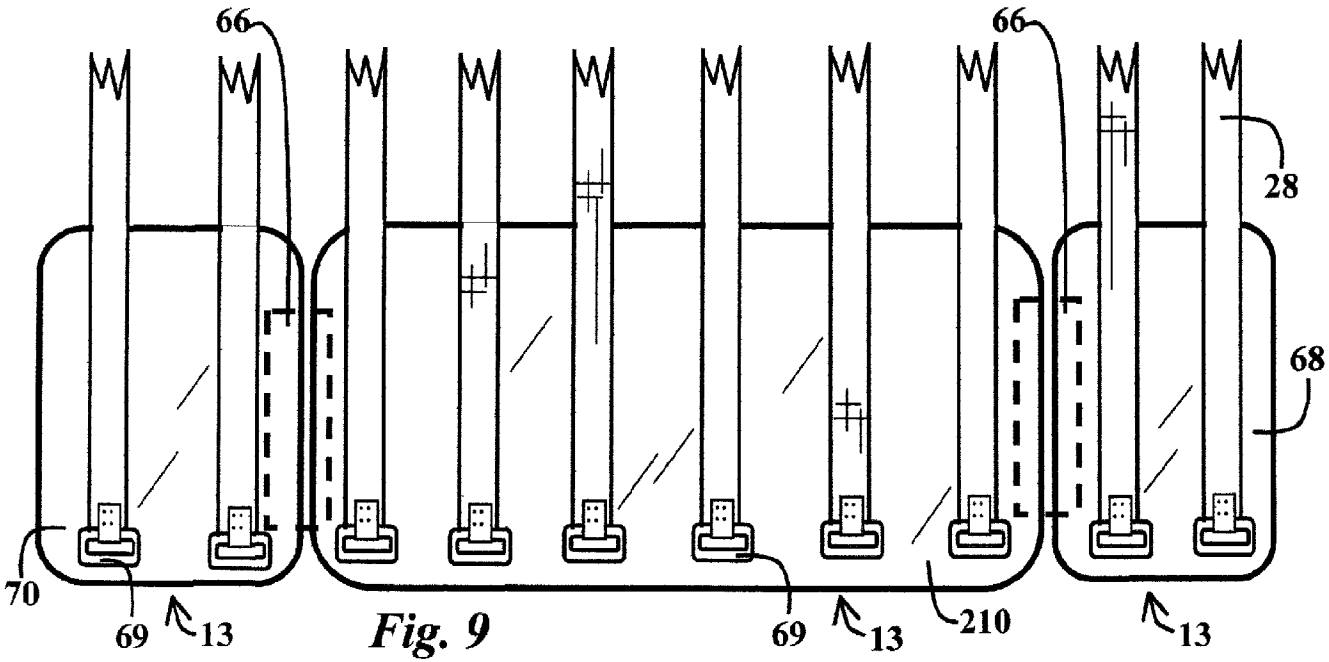
FIG. 9 is a bottom view of the transfer sheet and attachment straps used during stretcher formation in accordance with the present invention.

After forming the stretcher frame from the members of the lateral transfer structure 206, the transfer sheet 13 may be securely attached to the stretcher frame to form a completed stretcher 202. A bottom view of an illustrative transfer sheet 13 is shown in FIG. 9. As shown in FIG. 9, transfer sheet 13 may be segmented into multiple portions—i.e., central portion 210, footrest portion 70, and headrest portion 68. As indicated by dotted lines 66, VELCRO® fastening structures (hook and loop fasteners) or other suitable fastening structures may be used to connect the segments of the sheet 13 to each other. Straps 28 or any other suitable fasteners may be used to connect the sheet 13 to the stretcher frame. The use of straps to attach the transfer sheet 13 to the stretcher frame is used as an example.

Figure 10:
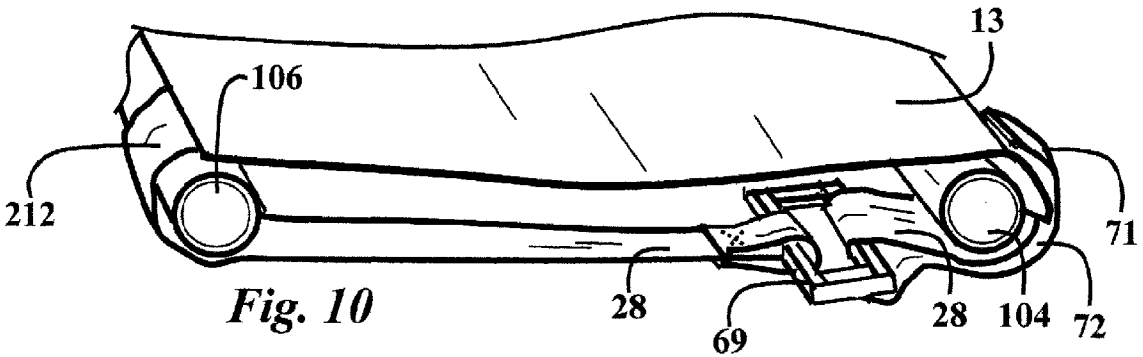
FIG. 10 is a perspective view of the end of the stretcher frame showing how the attachment straps are used to attach the transfer sheet to the stretcher frame in accordance with the present invention.

An end view of stretcher 202 showing how straps 28 may be used to attach the transfer sheet 13 to the frame is shown in FIG. 10. The portion of the frame shown in FIG. 10 has two components: stretcher lateral support member 106 and stretcher lateral support member 104. During stretcher formation, the portions of support member 106 (e.g., members 45 of FIGS. 4 and 6) are threaded through the six middle straps 28 of the seat and backrest portions of the transfer sheet 210, resulting in straps 28 that are looped around the frame. The two sets of straps 28 attached to the headrest 68 and footrest 70 portions of the transfer sheet are looped around the extended headrest lateral support members 12 and the extended footrest lateral support members 7.

In a typical scenario, a caregiver tugs on a portion 212 of each strap 28 to create slack in the straps 28.

On the side of the stretcher frame that includes lateral support member 106, the ends 26 and 56 of members 45 (FIGS. 4 and 6) are threaded inside straps 28 as shown in FIG. 10. Once threaded through all of the straps 28 and fully extended, the ends 26 and 56 can be secured using locking pin 54, as shown in FIG. 7.

On the side of the stretcher frame that includes lateral support member 104, strap ends 71 are loose and are looped around lateral support member 104 and D-ring strap fasteners 69. To complete the attachment process, the strap ends 71 are pulled tight. VELCRO® fastening structure (hook and loop fastener) portions 72 on straps 28 ensure that the tightened straps do not slip.

An illustrative transfer pad embodiment using normally deflated airbags 15 is shown in FIG. 11. Electric air pump 80 obtains power using cord 81 or a battery. Air pump 80 is used to inflate airbags 15 when it is desired to transfer a patient. Pressurized air is transferred from pump 80 to airbags 15 via air supply tubing 79. Tubing 79 is connected to each airbag 15 using a tubing connector 82. Foam or other suitable padding material 14 may be placed over the tubing 79 as a protective layer to help shield the patient from the tubing 79. When the airbags are pressurized, they inflate and form channels 34.

An illustrative transfer pad embodiment using normally inflated airbags 15, 78 is shown in FIG. 12. With this type of arrangement, airbags 15, 78 are normally inflated as shown in FIG. 12 to support the patient. When it is desired to move the patient from bed 23, pressurized air is released first from airbags 78. Deflating airbags 78 forms channels 34 that accommodate the extending members of slides 5 and 38. Airbags 15 are then fully or partially deflated once the stretcher is formed allowing the stretcher to support the patient instead of the airbags 15. Patients never come in contact with the air supply tubing in the normally inflated scenario, so extra padding such as mat 14 of FIG. 11 generally need not be used for patient comfort.

In the embodiments of FIGS. 11 and 12, the use of pressurized airbags is used as an example. In general, any suitable adjustable structures may be used in forming the channels 34 in the transfer pad to accommodate the extending frame support members from the lateral transfer structure 206. For example, other pressurized fluids may be used such as inert gases or liquids or mechanical lifts may be used (e.g., based on hydraulics, motors, or manually-driven lifting mechanisms). Moreover, it is not necessary to use an electric motor to pressurize the airbags. A manual pump or other pressurization scheme (e.g., pressurized air obtained from wall outlets) may be used if desired.

Figure 13:
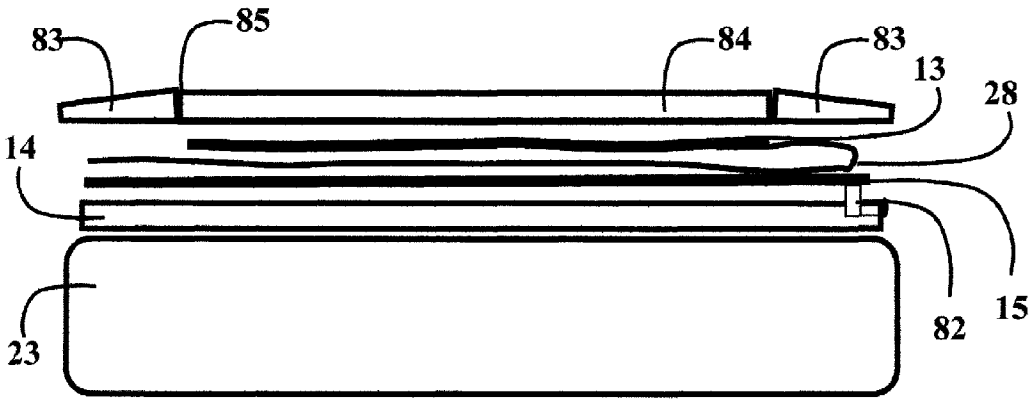
FIG. 13 is an end view of a patient support structure and normally-deflated airbag arrangement showing a mattress pad with unfolded flaps in accordance with the present invention.

An end view of an illustrative transfer sheet and bed arrangement is shown in FIG. 13. In the example of FIG. 13, a bed 23 or other suitable patient support structure has padding 14 for covering airbag tubing. Airbag 15 is shown in a deflated condition in FIG. 13. Connector 82 is used to supply air to the airbag when it is desired to form channels 34, as described in connection with FIG. 11. Transfer sheet 13 and attachment straps 28 rest on top of the mat 14. (In FIGS. 13 and 14, the layered components are shown as being slightly spaced from each other for clarity.)

Foam or other padding material 84 is placed on top of transfer sheet 13. The padding material may, for example, be based on a foam mattress or mattress pad, so material 84 is sometimes referred to as a mattress or mattress pad. In a hospital room environment (i.e., in a patient's room), mattress 84 preferably provides sufficient padding to overcome any minor unevenness created by the airbags 15, 78 or transfer sheet 13 and makes the patient's bed 23 comfortable for sleeping and resting.

A typical hospital bed 23 is about 36 inches wide. To ensure a suitable fit, the largest possible lateral dimensions of mattress 84 are typically matched to the lateral dimensions of bed 23, as shown in FIG. 13. In this configuration, the width of the mattress 84 will generally be too large to be easily transported throughout the hospital. This is because the width of a normal hospital bed is typically too large to comfortably pass through hospital corridors and elevators, particularly in crowded situations. Mattress 84 may therefore be provided with hinges 85 and flaps 83.

Figure 14:
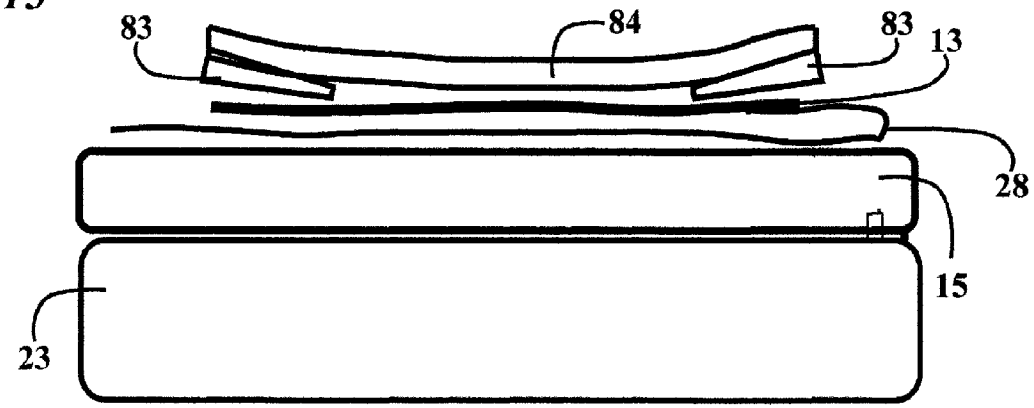
FIG. 14 is an end view of a patient support structure and normally-inflated airbag arrangement showing a mattress pad with folded flaps in accordance with the present invention.

As shown in FIG. 14, the hinges 85 allow the flaps 83 to be tucked under the central portion of the mattress 84. This reduces the lateral dimensions of the mattress so that the lateral dimensions of the mattress match the lateral dimensions of the transfer sheet 13 (e.g., about 24 inches), rather than the lateral dimensions of the bed 23. By adjusting the size of the mattress 84 in this way, it is not necessary to move the patient from the mattress 84 during transfer operations. Moreover, the extra thickness provided by the folded-under flaps 83 forms a cradle structure that helps to prevent unwanted lateral movement of the patient during the transfer process. FIG. 14 shows a bed arrangement for a normally-inflated airbag scenario (without the mat 14 to shield the airbag supply tubing that appears in FIG. 13), and shows how the airbags 15 appear when inflated.

In FIGS. 13 and 14, both normally-deflated and normally-inflated structures preferably use separate folding mattresses such as mattress 84 although in another suitable arrangement, the mattress may be integrated into the transfer sheet 13.

Figure 15:
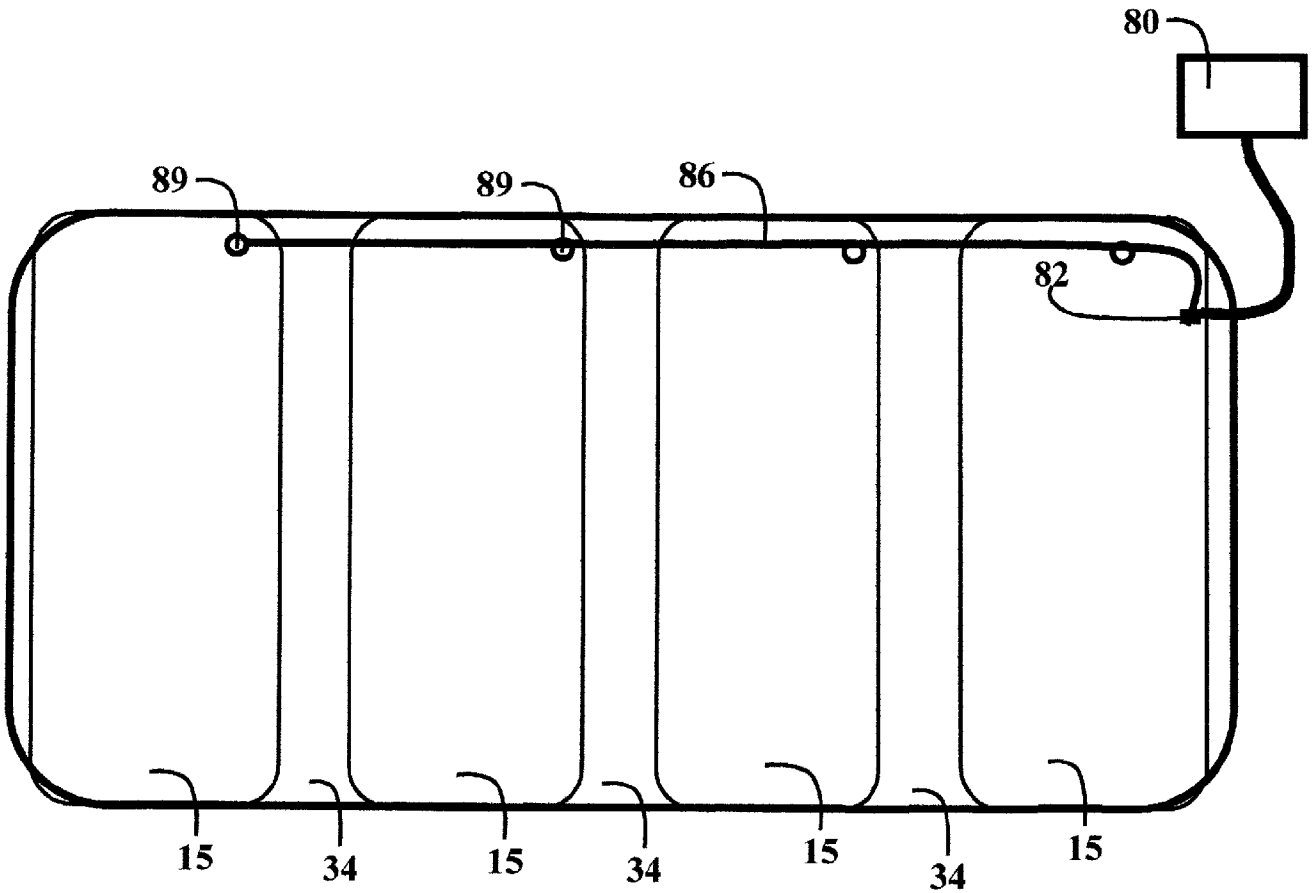
FIG. 15 is a top view of airbags that are normally deflated in accordance with the present invention.

A top view of the airbags 15 in a normally-deflated structure are shown in FIG. 15. Each airbag 15 has an inlet hole 89 on the underside that receives pressurized air from pump 80 via air supply tubing 86. A stopcock or other suitable valve may be used in the air supply tubing 86 to help control inflation/deflation. When inflated, channels 34 are formed that are wide enough to accommodate the extending portions of slides 5 and 38.

Figure 16:
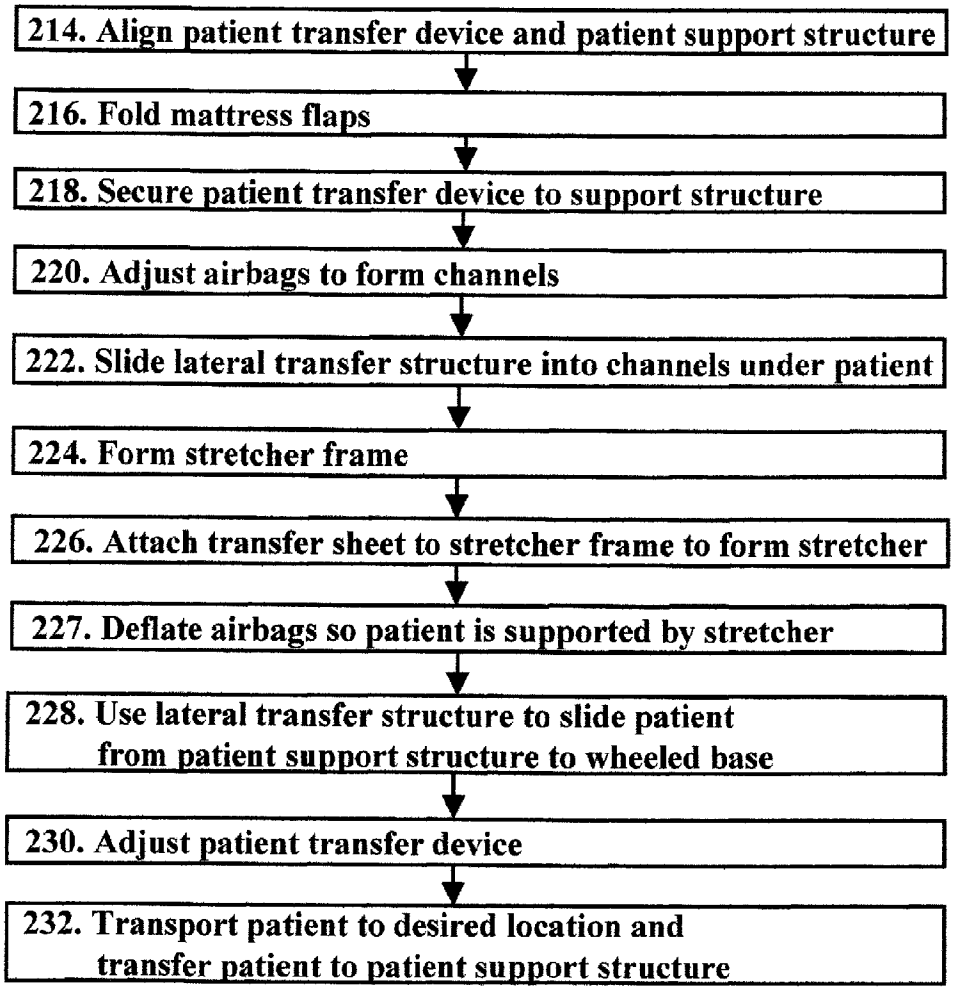
FIG. 16 is a flow chart of illustrative steps involved in using the patient transfer device and transfer pad structures to transfer patients between patient support structures in accordance with the present invention

Illustrative steps involved in using the patient transfer device 200 to transport a patient between two patient support structures are shown in FIG. 16.

At step 214, the patient transfer device 200 is aligned with the patient's patient support structure. For example, if the patient is lying in a hospital bed, the height of the bed can be adjusted so that the lateral support structure members such as slides 5 and 38 are aligned with the positions of the channels 34 that will be formed under the patient. If desired, the patient transfer device 200 can be provided with height-adjusting structures, although this would add cost and complexity to the device.

At step 216, the sides 83 of the mattress 84 are folded under, as described in connection with FIGS. 13 and 14. This reduces the mattress's lateral dimensions so that they match the lateral dimensions of the transfer sheet 13 and stretcher frame 202. With a typical scenario, the mattress 84 is reduced in size from 36 inches wide to 24 inches wide.

At step 218, the patient transfer device 200 may be secured to the bed 23 or other patient support structure (e.g., using straps or other fasteners). This step is optional, but helps to provide additional safety during the patient transfer process. The position of device 200 may be secured using wheelchair brakes, a clamp, etc.

At step 220, channels 34 are formed. For example, airbags 15, 78 may be adjusted by inflation or deflation, as appropriate. In a normally-inflated scenario, a stopcock may be opened to release air from channel-shaped airbags 78. In a normally-deflated scenario, airbag segments 15 under the patient may be pressurized to raise the patient from the bed.

At step 222, the lateral transfer structure 206 is positioned under the patient (i.e., the slides 5 and 38 are extended into the channels 34).

The stretcher frame is formed at step 224. During stretcher frame formation, frame tubes may, for example, be rotated and extended, as described in connection with FIGS. 4-7.

At step 226, the transfer sheet 13 is attached to the frame as described in connection with FIGS. 9 and 10. This forms a completed stretcher that will support the patient. The folded mattress rests on the transfer sheet 13.

At step 227, the airbags 15, 78 that support the patient are adjusted (i.e., partially or fully deflated) so that the lateral transfer structure (i.e., the completed stretcher 202) now supports the patient, not the airbags.

At step 228, the lateral transfer structure is used to slide the stretcher bearing the patient onto the wheeled base portion of the patient transfer device. Wheels 50 (FIG. 6) help to reduce friction and facilitate the transfer process.

At step 230, the patient transfer device 200 may be adjusted. For example, if it is desired to operate the patient transfer device 200 in wheelchair mode rather than gurney mode, the removable headrest and footrest can be retracted to allow the patient to sit on the patient transfer device 200, and the backrest can be inclined to the desired angle, as in FIG. 3. The wheelchair can be unclamped or unsecured from the patient support structure, and the sliding frame structure can be locked in place for secure patient transport.

Once adjustments of this step are complete, the patient transfer device can be used to transport the patient to another patient support structure (e.g., an examining table, medical testing table, a hospital bed, etc.), to another medical facility using a wheelchair van, or to a recreation room in a nursing home facility (step 332). The patient is unloaded from the patient transfer device by placing the device in gurney mode, aligning the device with the patient support structure, laterally transferring the patient and stretcher to the support structure, ensuring that channels 34 are created (i.e., adjust airbags), releasing the transfer sheet from the stretcher frame, retracting the lateral transfer structure onto the wheeled base, and adjusting the airbags to their normally-inflated or normally-deflated configuration to create a flat patient support surface.

The foregoing is merely illustrative of the principles of this invention and various modifications can be made by those skilled in the art without departing from the scope and spirit of the invention.

What is claimed is:

1. A method for transferring a patient between a patient support structure and a patient transfer device, wherein the patient transfer device has a wheeled base and a lateral transfer structure attached to the wheeled base, and wherein the lateral transfer structure has extending members, the method comprising:

extending the extending members of the lateral transfer structure under the patient;

forming a stretcher for the patient from the extending members that have been extended under the patient; and retracting the stretcher formed from the extending members to transfer the patient from the patient support structure onto the wheeled base of the patient transfer device, wherein the extending members comprise portions that pivot and wherein forming the stretcher comprises forming a frame for the stretcher by pivoting the portions that pivot.

2. The method defined in claim 1 wherein forming the stretcher further comprises attaching a patient transfer sheet to the frame before retracting the stretcher.

3. The method defined in claim 2 wherein attaching the patient transfer sheet to the frame comprises attaching the patient transfer sheet to the frame using hook and loop fasteners.

4. The method defined in claim 2 wherein the patient transfer sheet is attached to the frame using a fastening mechanism that pulls the patient transfer sheet tight across the frame.

5. The method defined in claim 1 further comprising lowering the patient onto the stretcher before retracting the stretcher.

6. The method defined in claim 1 wherein the stretcher is substantially rectangular, wherein the extending members are parallel to each other, and wherein forming the stretcher comprises attaching a patient transfer sheet to the portions that pivot before retracting the stretcher.

7. A method for transferring a patient between a patient support structure and a patient transfer device, wherein the patient transfer device has a wheeled base and a lateral transfer structure attached to the wheeled base, and wherein the lateral transfer structure has extending members, the method comprising:

extending the extending members of the lateral transfer structure under the patient;

forming a stretcher for the patient from the extending members that have been extended under the patient; and retracting the stretcher formed from the extending members to transfer the patient from the patient support structure onto the wheeled base of the patient transfer device, wherein the extending members comprise at least two parallel portions, wherein at least one of the extending members has a rotatable portion, and wherein forming the stretcher comprises forming a frame by rotating the rotatable portion and connecting the parallel portions together using the rotatable portion.

8. The method defined in claim 7 wherein the rotatable portion is parallel to the parallel portions while the extending members are being extended under the patient, wherein the rotatable portion is perpendicular to the parallel portions when the parallel portions are connected together by the rotatable portion, and wherein forming the stretcher further comprises attaching a patient transfer sheet to the frame before retracting the stretcher.

9. A method for transferring a patient between a patient support structure and a patient transfer device, wherein the patient transfer device has a wheeled base and a lateral transfer structure attached to the wheeled base, and wherein the lateral transfer structure has extending members, the method comprising:

extending the extending members of the lateral transfer structure under the patient;

forming a stretcher for the patient from the extending members that have been extended under the patient; and retracting the stretcher formed from the extending members to transfer the patient from the patient support structure onto the wheeled base of the patient transfer device, wherein the extending members comprise at least three extending members with parallel portions, wherein two of the extending members have rotatable portions, and wherein forming the stretcher comprises forming a frame by rotating the two rotatable portions and connecting the parallel portions together using the two rotatable portions.

10. The method defined in claim 9 wherein the two rotatable portions are parallel to the parallel portions while the extending members are being extended under the patient, wherein the two rotatable portions are perpendicular to the parallel portions when the parallel portions are connected together through the rotatable portions, and wherein forming the stretcher further comprises attaching a patient transfer sheet to the frame before retracting the stretcher.

11. A method for transferring a patient between a patient support structure and a patient transfer device, wherein the patient transfer device has a wheeled base and a lateral transfer structure attached to the wheeled base, and wherein the lateral transfer structure has extending members, and wherein the patient is initially on a flexible sheet on the patient support structure, the method comprising:

extending the extending members of the lateral transfer structure under the patient;

after extending the extending members of the lateral transfer structure under the patient, forming a stretcher for the patient from the extending members that have been extended under the patient and from the flexible sheet; and retracting the stretcher formed from the extending members and the flexible sheet to transfer the patient from the patient support structure onto the wheeled base of the patient transfer device, wherein:

the extending members form at least part of a stretcher frame;

forming the stretcher from the extending members that have been extended under the patient and from the flexible sheet comprises attaching the flexible sheet to the stretcher frame before retracting the stretcher;

the lateral transfer structure includes a fastening mechanism; and attaching the flexible sheet to the stretcher frame comprises using the fastening mechanism to tighten the flexible sheet across the stretcher frame.

12. The method defined in claim 11 further comprising, before extending the extending members of the lateral transfer structure under the patient, raising the patient from the patient support structure.

13. The method defined in claim 11 further comprising forming channels under the patient, wherein extending the extending members of the lateral transfer structure under the patient comprises extending the extending members of the lateral transfer structure through the channels under the patient.

14. The method defined in claim 11 wherein the stretcher comprises a backrest, the method further comprising:

after retracting the stretcher formed from the extending members and the flexible sheet to transfer the patient from the patient support structure onto the wheeled base of the patient transfer device, inclining the backrest.

15. The method defined in claim 11 wherein the stretcher comprises a footrest, the method further comprising:

after retracting the stretcher formed from the extending members and the flexible sheet to transfer the patient from the patient support structure onto the wheeled base of the patient transfer device, removing the footrest.

16. The method defined in claim 11 wherein the stretcher comprises a footrest formed from extending footrest members that extend from the stretcher, the method further comprising:

after retracting the stretcher formed from the extending members and the flexible sheet to transfer the patient from the patient support structure onto the wheeled base of the patient transfer device, retracting the extending footrest members that form the footrest.

17. The method defined in claim 11 wherein the stretcher comprises a headrest, the method further comprising:

after retracting the stretcher formed from the extending members and the flexible sheet to transfer the patient from the patient support structure onto the wheeled base of the patient transfer device, removing the headrest.

18. The method defined in claim 11 wherein the stretcher comprises a headrest formed from extending headrest members that extend from the stretcher, the method further comprising:

after retracting the stretcher formed from the extending members and the flexible sheet to transfer the patient from the patient support structure onto the wheeled base of the patient transfer device, retracting the extending headrest members that form the headrest.

* * * * *